US011078696B2

(12) United States Patent
Thomas, II

(10) Patent No.: US 11,078,696 B2
(45) Date of Patent: Aug. 3, 2021

(54) SLUDGE CONTAINMENT VESSEL AND METHOD FOR USE IN CONCERT WITH A VACUUM TRUCK IN SPILL CONTAINMENT

(71) Applicant: Terrance R. Thomas, II, Kent, WA (US)

(72) Inventor: Terrance R. Thomas, II, Kent, WA (US)

( * ) Notice: Subject to any disclaimer, the term of this patent is extended or adjusted under 35 U.S.C. 154(b) by 242 days.

(21) Appl. No.: 16/295,894

(22) Filed: Mar. 7, 2019

(65) Prior Publication Data

US 2020/0284073 A1 Sep. 10, 2020

(51) Int. Cl.

| | |
|---|---|
| ***B65D 90/00*** | (2006.01) |
| ***E05C 3/00*** | (2006.01) |
| ***E05C 1/00*** | (2006.01) |
| ***B65D 88/12*** | (2006.01) |

(52) U.S. Cl.

CPC ..... *E05C 3/006* (2013.01); *B65D 88/121* (2013.01); *B65D 90/008* (2013.01); *E05C 1/002* (2013.01); *B65D 2588/12* (2013.01)

(58) Field of Classification Search

CPC ..... B65D 51/002; B65D 51/1661; B65D 90/008; B65D 88/121; B65D 88/12; B65D 90/18

See application file for complete search history.

(56) References Cited

U.S. PATENT DOCUMENTS 6,929,146 B1 * 8/2005 Galbreath ..... B65D 90/008 220/833

2016/0318707 A1 * 11/2016 Markham ..... B65D 90/0033

* cited by examiner

*Primary Examiner* — Anthony D Stashick
*Assistant Examiner* — Pierce T Dunwoody
(74) *Attorney, Agent, or Firm* — Williams Kastner & Gibbs PLLC; Mark Lawrence Lorbiecki

(57) ABSTRACT

A container for use with a vacuum truck includes a container body. The container body defines a door opening and a container closure including a door panel sized to fit the door opening. The door panel is hingedly attached relative to rear frame elements at the hinge side and is movable to occupy the door opening. The door panel defines a drain port under a horizontal beam. The drain port includes a stopcock having an open and a closed state. The stopcock is selectably movable from the open to the closed state or from the closed to the open state. The container body defines at least two additional ports situated above the midpoints of the frames and includes fittings to engage vacuum hoses such that any volume the vacuum truck draws through one of the hoses, the container body draws a corresponding volume through the other of the two ports.

19 Claims, 9 Drawing Sheets

SLUDGE CONTAINMENT VESSEL AND METHOD FOR USE IN CONCERT WITH A VACUUM TRUCK IN SPILL CONTAINMENT

FIELD OF THE INVENTION

This invention relates generally to intermodal shipping containers and, more specifically, to vacuum oil-containment containers.

BACKGROUND OF THE INVENTION

The 2013 Mayflower oil spill occurred on Mar. 29, 2013, when the Pegasus Pipeline, owned by ExxonMobil and carrying Canadian Wabasca heavy crude from the Athabasca oil sands, ruptured in Mayflower, Ark., about 25 miles (40 km) northwest of Little Rock releasing about 3,190 barrels (134,000 US gal; 507 m3) of oil. Approximately 12,000 barrels (500,000 US gal; 1,900 m3) of oil and water mix was recovered. Twenty-two homes were evacuated. The United States Environmental Protection Agency (EPA) classified the leak as a major spill.

Early images from local media showed crude oil running along a suburban street and across lawns. The pipeline was shut after the leak was discovered on March 29. Twenty-two homes were evacuated. The oil flowed into storm drains leading to nearby Lake Conway, a fishing lake. First responders, including fire fighters, city employees, county road crews and police built dikes to block culverts and stop the crude from fouling the lake. ExxonMobil deployed 3,600 feet (1,100 m) of containment boom around the lake. ExxonMobil said that by early morning on March 30 there was no more oil spilling from the pipeline and fifteen vacuum trucks, 33 storage frac tanks and 120 workers were deployed to help clean up and temporarily store the oil.

The principal issue when cleaning up an oil spill or water is the speed in containment and collection. Cleanup activities in the Mayflower case were focused on the North Woods Subdivision adjacent to the pipeline to remove all free oil from the roadway, storm drain and residential yards. This includes utilizing pads and power washing streets and driveways that have been impacted. Vacuum trucks collected all the oil and sudsy oily water from power washing. Ideally, the vacuum trucks would be numerous enough to collect the oil before it posed a larger threat than to the immediate area of the spill. But vacuum trucks have limited capacity and when full must transport the oil to a frac tank farm to empty the vacuum trucks for another turn at collection.

Oil is relentless and will continue to flow downward under the influence of gravity. It will not wait through the interval when the vacuum truck is transporting oil to the frac tank farm. Yet, the more oil collected in early stages, the smaller the contaminated area. The most effective predictor of ecological damage is the residence interval where the oil is uncollected and allowed to spread. Faster collection means less damage.

Using a vacuum unit is one of the most acceptable methods for removing a contained oil spill, Vacuum units are most effective when a spill has been contained in thick pockets of relatively pure oil. Because of the high per-hour cost of operating vacuum units, their use will not be the most cost-effective method for removing small, or widely dispersed, thin layer oil spills. Better not to let the oil disperse through rapid deployment of crews with vacuum trucks.

As discussed above, one bottleneck modulates any progress in collecting oil, the availability of vacuum trucks. By conventional collection methods, vacuum trucks are sent to the site of an oil spill. Workers vacuum oil, water, and soil to contain and collect spilled oil. Then, when the vacuum truck reaches its collection capacity, the truck is drive to a frac tank farm to relieve itself of its oily burden and transferred to frac tanks for temporary storage of spilled oil. The frac tank is a large heavy gauge steel tank that is pulled by a semi-tractor to the frac tank farm or the final disposal site, Frac tanks are also sometimes known as fixed-axle storage tanks. Given its exceptionally large size, the conventional frac tank is hauled to a frac tank farm by a tractor.

However, performing collection by the conventional method, the vacuum truck only functions as a collector for a portion of the duty cycle then it is not being used as a transport. Considering that the duty cycle must include the shuttling between the collection site and the frac tank farm both from the collection site and to it as well as the time spent waiting to evacuate the vacuum truck into the frac tank. In many cases, the major part of the interval is consumed in transportation rather than in collection. Yet, while transporting oil or the empty truck, the highly specialized equipment the vacuum truck comprises is idle. What is needed in the art is a method and equipment to allow the greater use of the specialized vacuum equipment for collection rather than to remain idle during transportation. To the greatest extent possible, vacuum trucks ought to remain in a posture and available for collection of oil to more immediately contain and collect oil.

The invention is based upon a 45-foot-long intermodal shipping container (referred to herein as either a "container" or "shipping container" the inventor intends as equivalent expressions). Intermodal shipping containers can be used in general to hold and ship various materials, including bulk materials. An intermodal container is a large standardized shipping container, designed and built for intermodal freight transport, meaning these containers can be used across different modes of transport—from ship to rail to truck—without unloading and reloading their cargo. Such shipping containers are advantageously provided with closures at reinforced framed openings in a side or end wall. The presence of connector fittings at standard spacing (typically at each of the eight corners of a rectangular container) and these connector fittings enable the intermodal container to be affixed to mountings placed at the same standard spacings on movable chassis configurations appropriate for road, rail, sea or other transport, for stacking and the like. Likewise, containers so configured can be manipulated using lifts and spreader frames having grappling devices at the standard spacings.

Ninety percent of the global container fleet consists of "dry freight" or "general purpose" containers—both of standard and special sizes. Containers are transferred between rail, truck, and ship by container cranes at container terminals. Forklifts, reach stackers, straddle carriers, and cranes may be used to load and unload trucks or trains outside of container terminals. Swap bodies, sidelifters, tilt deck trucks, and hook trucks allow transfer to and from trucks with no extra equipment. ISO-standard containers can be handled and lifted in a variety of ways by their corner fixtures, Containers can be transported by container ship, truck and freight trains as part of a single journey without unpacking. Units can be secured in transit using "twistlock" points located at each corner of the container.

Where a single door panel is used, that door panel is carried on a hinge, i.e., a pivot axis along the frame at one side of the end wall. Usually the hinge axis oriented vertically. A sealing door panel preferably has a single integral panel as large as the opening, but two panels hinged on opposite sides of the opening are possible, as are two or more panels with an intermediate accordion fold hinge. Various mechanisms can releasably hold the door panel(s) in a closed position, typically involving a latching connection between the door panel and the frame of the doorway, at one or more points remote from the hinge axis.

For convenience of discussion, this disclosure refers primarily to an integral door panel having a vertical hinge axis along one lateral edge or corner of the container and a latching connection along a frame at the opposite edge. It should be appreciated that many of the same considerations apply to other configurations and orientations, including paired or bipanel doors.

A hinged door panel inherently applies greater force to the seal near the hinging axis and less force farther from the hinging axis, due to simple mechanical leverage. It is desirable to apply sufficient force against the sealing plane all around the seal, to obtain and maintain a preferably watertight seal barrier. It is desirable to avoid crushing the gasket close to the hinge, which over a few repetitions of opening and closing will permanently compress the gasket material there. The mechanical arrangements must permit the operator manually to exert pressure against the door panel adequate to close the door against the seal. In a heavy-duty container, this includes applying sufficient pressure against a heavy hinging door panel to compress a relatively stiff gasket material along the edge of the panel that is opposite from the seal. In a container that may contain liquids or a combination of solids and liquids, particularly a waste container, it is also advantageous to pay attention to the seal along the lower edge of the container to prevent fluid leakage.

Typically, on the hinge axis side and on the opposite side (generally the latching side), one or more ratchet binders is mounted to exert a force pulling the door panel against the seals. A ratchet binder is a ratchet-pawl threaded turnbuckle-like connection, used to foreshorten the distance between ends at which the ratchet binder is permanently or releasably attached. Other similar force exertion mechanisms could also be used, such as toggling bale clamps, hydraulic or pneumatic spring cylinders, etc.

Along the bottom edge of the panel at the sill of the opening, compression flaps may, optionally, be mounted on a horizontal pivot axis and can be rotated against the bottom edge of the door panel. These flaps can help to apply additional force specifically along the bottom edge of the panel, to offset the effects of leverage that tend to apply more force near the hinge axis and less force at points spaced from the hinge axis, Generally, flaps can be pivoted downwardly to clear the way for the door panel to pivot open. Pressure applied to the ends of the lock shaft can adjust the extent to which the locking fingers exert pressure on the door panel, normally increasing the sealing pressure applied on the bottom edge of the panel to better seal against leakage.

The lock shaft can be biased to apply more pressure to locking fingers that are remote from the hinging axis, and thus to offset uneven effects of hinge leverage). Inasmuch as the lock shaft and the locking fingers are mounted in a straight line, the variation in applied pressure is linear across the bottom edge of the door panel.

The foregoing arrangements are directed to the hinging and bottom edges of a unitary door panel. Closure arrangements, preferably including the application of pressure against the seal, also are needed along the edge of the door panel that is parallel to the hinge axis but on the opposite side of the door panel. A gate latch is possible, but this edge also needs to seal, and does not benefit from hinge leverage. Pressure also needs to be applied, preferably at a level that is comparable to the pressure applied on the hinged side having the benefit of hinge leverages.

In certain door closures, typified by the bi-panel door closures, a cam lock arrangement is provided to make a latching closure remote from the hinge axis. Normally, the cam lock arrangement is at the midpoint of the rear wall of the container. The cam lock attaches the panels to one another and potentially also locks at least an outer one of two lapped panels to the doorway header and sill members framing the top and bottom edges of the doorway. A locking rod is mounted along and parallel to the closure edge of the outer panel and has an operating handle that extends perpendicular to the locking rod. One or more eccentric cams (e.g., a cam at each end of the lock rod) extends from the locking rod. The cam is angularly spaced from the lever handle on the lock rod and aligns with a receiving pocket in the opposed panel or in the header or sill frame members. The operator swings the doors to a point where they are almost but not entirely closed, fits the cam or cams into the pocket(s) and rotates the lock rod using the lever handle. Rotation of the lock rod causes the cams to bear against the pockets and pulls the panels closed.

A cam lock handle, as described, requires some coordination in the operation of the lever handle and the position of the door panels. Specifically, the panels must be held manually in a nearly-closed position to align the cams and the cam pockets. This has proven to be difficult to accomplish with heavy duty sealing sludge containment vessel door panels because the sealing gaskets are stiff and difficult or impossible for an operator to compress simply by pushing against the door panel.

Intermodal shipping containers have the virtue of standardization and are readily moved by such means as a reach stacker. As such, containers can be economically moved by any of several vehicles specifically designed to the task, thereby making the contents of the container readily transferred to finally be disposed of at a competent facility capable of properly refining collected oil into useful product or to otherwise process spilled chemicals and to separate out such other debris as might have been swept into the container.

A 45' high cube container has external dimensions of 45' in length, 9.6 in height, and 8.0' in width. The internal volume is 3,040 ft.$^3$ with a maximum gross weight of 66,139 lb. with a net cargo weight of 55,559 lb. However, understanding that water has a density of about 62.4 lb/ft.$^3$, a standard container full of water would be nearly 3.5 times as heavy as the rated net cargo weight, Additionally, a standard container is poorly suited for carrying oil. With internal dimensions of 44'4" in length (532"), 8'9$\frac{15}{16}$" and in height (105$\frac{15}{16}$"), the interior side wall presents 56,358¾ inch$^2$ in surface. One atmosphere at 14.69 lb./inch$^2$ exerts 82,824.55 lbs. or 414 tons of pressure on the structure.

A normal container is not configured for such loads. Also, a container has doors making it poorly configured to act as a storage repository for sludge in that doors will not facilitate transfer of content from the container without specialized hoppers. There is need in the art for a more suitable means for containing collected sludge.

BRIEF DESCRIPTION OF THE DRAWINGS

Preferred and alternative examples f the present invention are described in detail below with reference to the following drawings.

DETAILED DESCRIPTION OF THE PREFERRED EMBODIMENT

Figure 1:
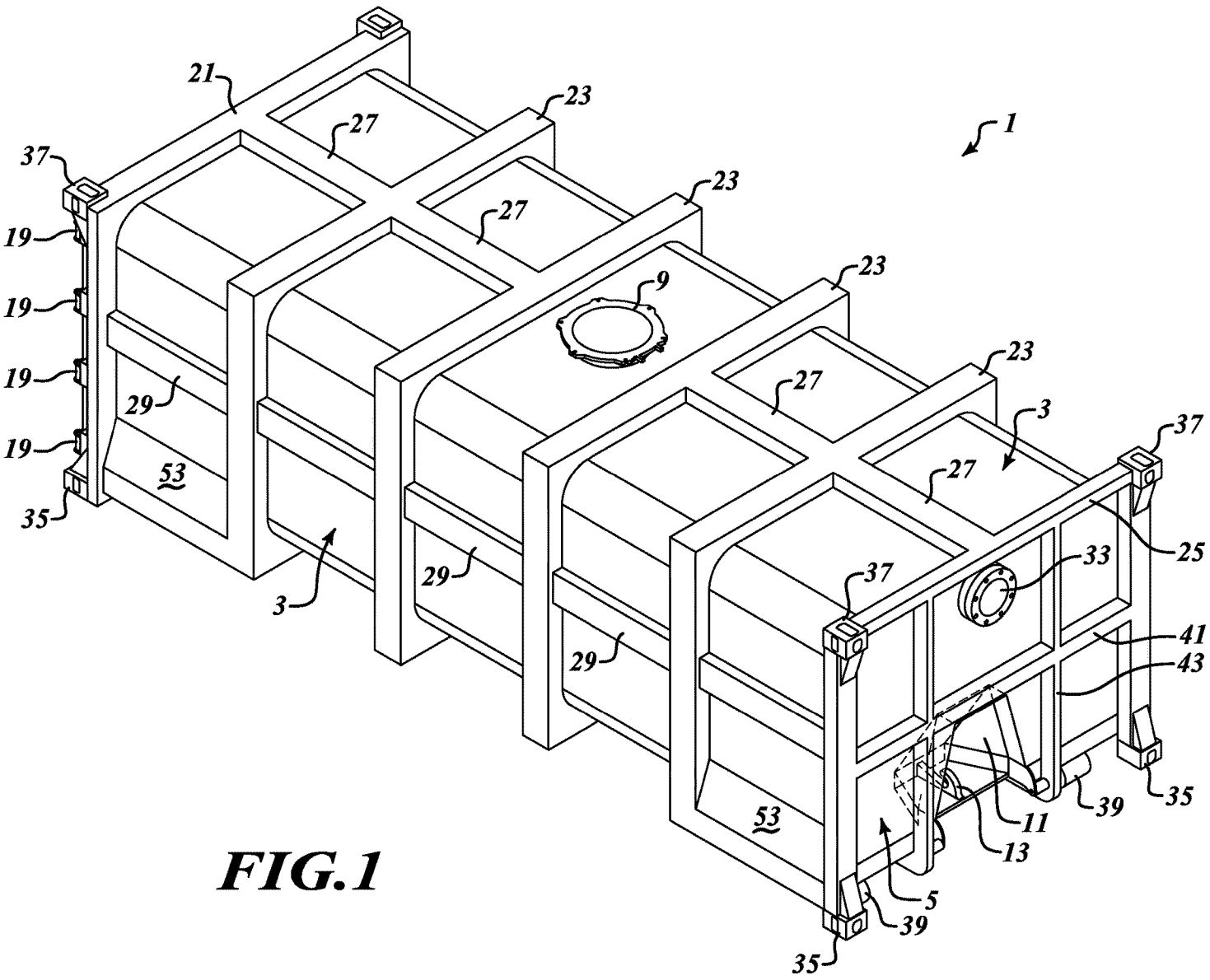
FIG. 1 is a perspective view of an inventive sludge containment vessel for spill collection for use in conjunction with a vacuum truck.
Figure 3:
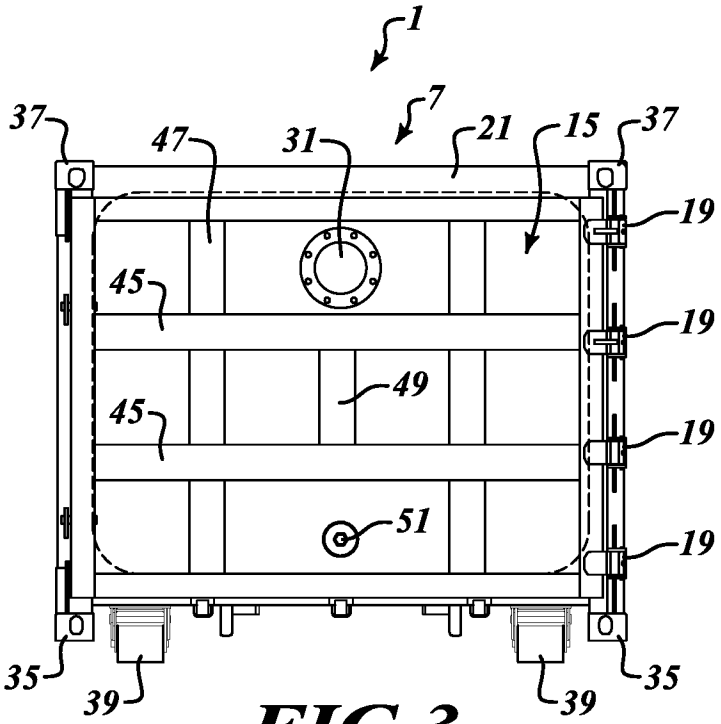
FIG. 3 is a rear elevation of the inventive sludge containment vessel.
Figure 2:
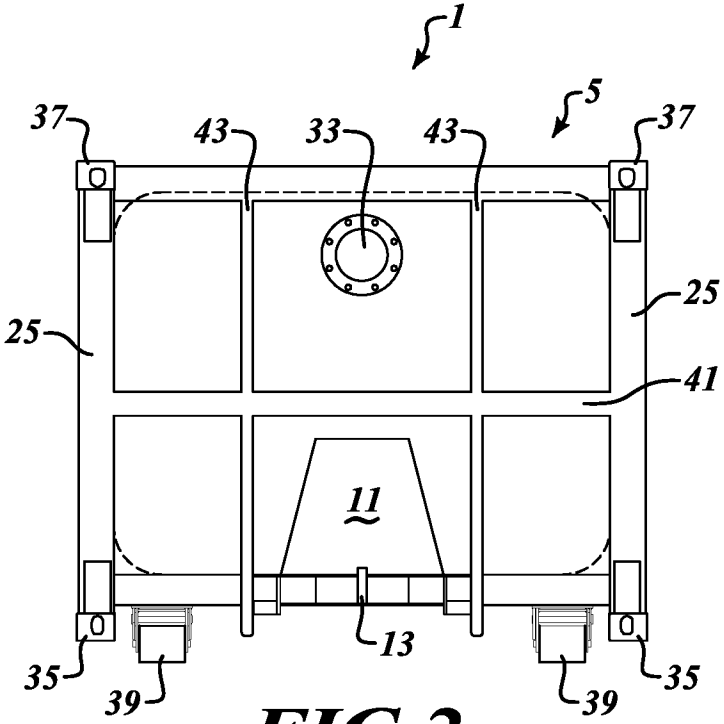
FIG. 2 is a front elevation of the inventive sludge containment vessel.
Figure 4:
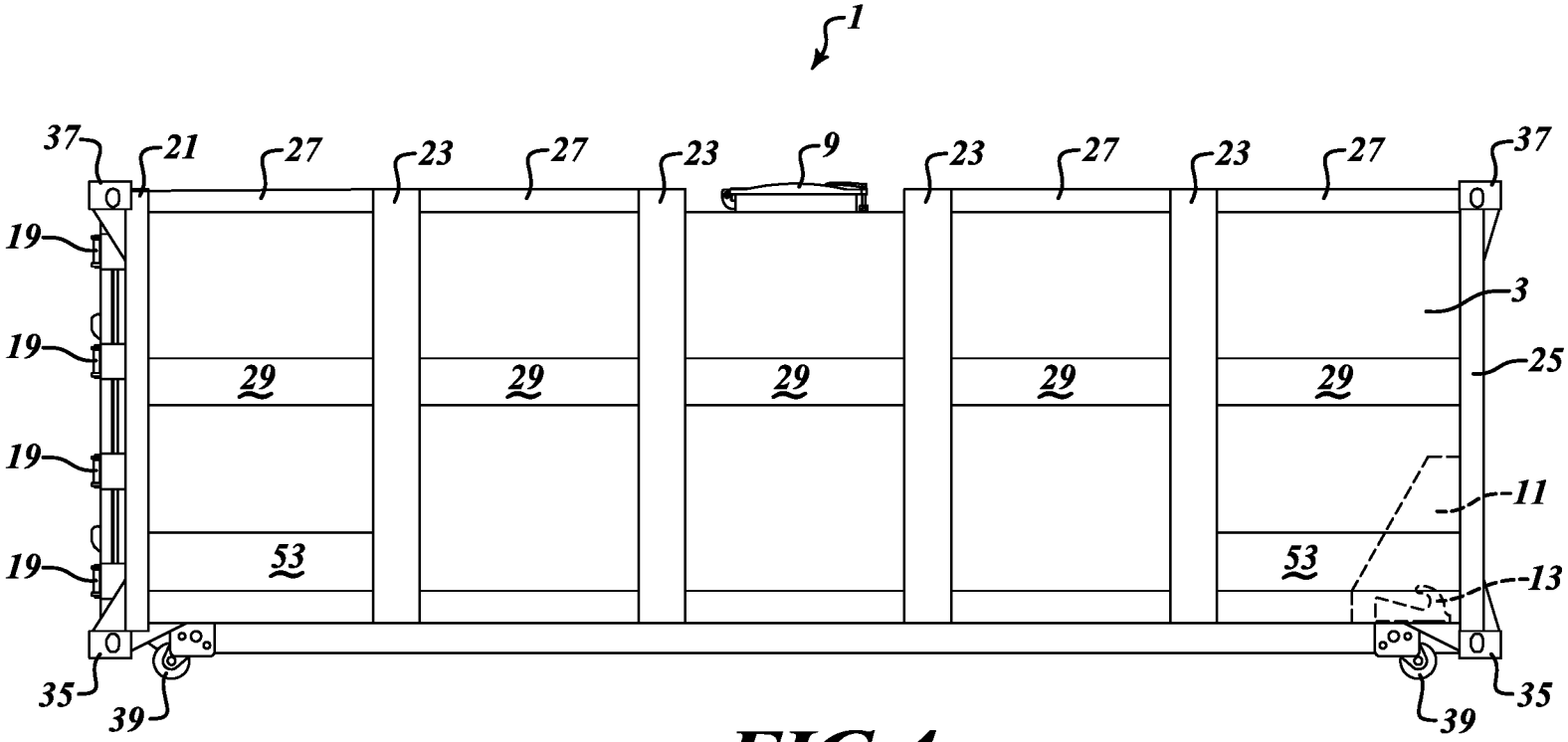
FIG. 4 is a left elevation of the inventive sludge containment vessel.

A vacuum truck is specially designed to pump excess liquid waste from catch basins, septic tanks, oil spills, and similar places. Commonly used for commercial as well as residential purposes, vacuum trucks not only carry out industrial waste material clean-up jobs but also perform waste removal jobs for municipalities which include street sweeping, sewer cleanup and much more. These vehicles used for suctioning, transporting, and disposal of toxic and non-toxic materials and to pump anything from domestic septic tanks to contaminated soil.

Vacuum trucks balance the engineering objectives necessary both for each of collecting and transporting wet and dry, industrial waste. Generally, the vacuum units are extremely versatile providing vacuuming/suctioning selectably at either of high-velocity or low-velocity air suction for removing any of solid, liquid, and frothy or sludge materials. Some other uses for which vacuum trucks are engineered include removal of brine water, cleaning oil spills, septic tanks and congested drainage systems.

The portable container 1 as shown in FIGS. 1 through 5, is configured generally as a rectangular prism comprising six faces that are rectangular in shape. The container 1 includes an containment wall 3 is formed as a generally rectangular tube extending from a front wall 5 and a rear wall 7. The containment wall 3 is formed in a manner similar to the skin of a fuselage of an aircraft, in that it is supported by a number of rectangular frames formed of rectangular tubing although in the presently preferred embodiment, the frames support the containment wall 3 from the exterior rather than the interior in order to preserve a smooth surface within to allow full evacuation of fluid contents. The rectangular frames comprise a rear frame 21 that defines the rear wall 7, several intermediate frames 23, and a front frame 25 that defines the front wall.

The interior of the containing wall 3 is generally octagonal in cross-section. While the containing wall 3 of the embodiment described herein is of an irregular octagonal, shape, alternate embodiments may have substantially any reasonable cross-sectional shape (e.g. rectangular, pentagonal, etc.). Fixedly connected to the rear frame 21, intermediate frames 23 and the front frame 25, respectively, which together form a continuous sealing bead. The containment wall 3 defines an aperture including an inspection panel 9 which might optionally include a sight glass to allow an operator to visually ascertain the volume of fluid the container 1 contains.

The rear wall 7 includes a monolithic door 15 having a rear door gasket 17. The rear door is pivotally attached to the rear wall by a plurality of hinges and defines a rear fitting aperture including a rear hose fitting 31. The hinges 19 are fixed on the rear frame 21 in the preferred embodiment. The rear frame 21 includes bottom post members 35 and top post members 37 formed to comply with ISO standards generally as metal castings. Top and bottom post members 37 and 35 are commonly referred to as corner castings. Container corner castings are actually the corners of a shipping container. Corner castings are the structural element of a shipping container allowing it to be connected to other containers both horizontally and vertically as well as being connected to transport modes including ship, rail and road. The specific manner of manufacture of the top and bottom post members 37 and 35 are not claimed as inventive and their function, in accord with standard practice might, optionally be performed by forging, welded fabrication or any other suitable way. The rear frame 21 is of conventional construction and are of a selected strength sufficient to support a plurality of containers thereabove. Generally, each of the top corner casting and one bottom corner casting 37 and 35 are have at least one recess, socket or opening formed therein and configured to receive a coupling or locking mechanism (not shown) for securing the container to a support member, to another container, or to lift and carry the container by means of a sling or a spreader bar (also not shown).

The front frame 25 also includes bottom post members 35 and top post members 37 formed to comply with ISO standards. The container 1 is configured to rest on the ground at the bottom post members 35 as well as on the buttressed ground pads 53 welded at the corners. The front wall 5 comprises support rollers 39 mounted on each side of the container 1. The support rollers 39 are mounted on brackets extending from the front frame 25 adjacent to a cavity 11 the front wall 5 defines. The cavity 11 defined in the front wall 5 of the container 1 houses a hook bracket 13 for attaching a cable thereto. The hook bracket 13 is mounted within the cavity 11 projecting inwardly from the bottom, center of the front wall 5.

As will be discussed in greater detail below, in use, the pressure the atmosphere exerts against walls of the container 1 require substantial bracing. For that reason, the front wall 5 includes a front wall horizontal beam 41 in the preferred embodiment. Likewise, front wall vertical ribs 43 further enhance the rigidity of the front wall 5.

The rear door 15 requires even further rigidity in order to preserve the flatness of the door relative to a rear door gasket 17 that provides the seal. For that reason, the rear door, in this preferred embodiment, includes two rear door horizontal beams 45 and two full-height rear door vertical ribs 47.

In this embodiment, a rear door stiffener 49 is inserted to further assure flatness of the rear door 15. Also shown are the rear door hose fitting 31 and the drain stop cock 51, a valve to allow evacuation of fluid prior to releasing the rear door 15.

The design requirements for a gasket joint requires flatness of the door to ensure that the flange is in good contact with the gasket. So long as the mating surfaces are smooth, clean, and the gasketing material is resilient, maintenance of door flatness can assure a good seal. The compressibility of the gasket must accommodate any flange irregularities so that adequate compression is applied to the gasket along its entire length thereby compensating for both high and low spots. The compression must not be so high that gasket damage occurs. In sealing, the knife edge plunges into the gasket causing the seal. With tubular gaskets the knife edge collapses the gasket rather than compressing it. The knife edge should not penetrate the gasket by more than 50% of its diameter or there may be a danger of the gasket being unable to recover due to the excess pressure applied by the knife edge.

In more detail, each of the containment walls 3 are secured to the tubular frame members 21, 25, and 27 formed as rectangular frames generally as weldments. Tubular structural tubes are selected rather than open profile (such as linear iron formed with a U-shaped or I-shaped cross-section) as the preferred embodiment of invention though the invention can be practiced with open profile shapes. The description of this preferred embodiment is not meant to, in any way, limit the invention to embodiments constructed using open profile shapes. Technology for efficiently mass-producing square and rectangular structural tubes has developed in the past few decades, generating research on member and connection behavior with subsequent development of design criteria. There are several advantages associated with the tubular section as opposed to shapes with open profiles.

Since the moment of inertia is the same about any axis for round and square tubes, these sections are the most efficient for columns that have the same end restraints in any direction. For different end restraints about the principle axes, a rectangular tube can be selected with proportions that provide the same column slenderness ratio about the major and minor axes, thereby providing the most efficient use of material. The section modulus can also be optimized for beams in biaxial bending.

The torsional stiffness of the closed shape and the high weak axis moment of inertia minimize the requirements for lateral bracing of tubular beams. Round and square sections require no lateral bracing and rectangular beams bending about the major would require lateral bracing only for extreme depth to width ratios. The torsional stiffness and strength also make tubes the ideal shape for space frame construction.

The smooth profile has aesthetic appeal for exposed members and the resistance to fluid flow forces (wind or water) is minimized. The profile provides the minimum surface area which minimizes costs for painting and other surface maintenance requirements. The minimum surface is also an advantage for structural members in clean production facilities.

The front, rear and intermediate frames 25, 23 and 21 respectively are separated by stringers 27 and on lateral faces, longerons 29. The stringers fix, spatially, the relation between adjacent frames such as between the front frame 25 and a first intermediate frame 23. The stringers 27 also have a great contribution to the structural strength of the container 1. In this embodiment, the stringers have the same section as the frames themselves. On the other hand, longerons extend from the front frame 25 to the rear frame 21 through the intermediate frames along the lateral faces of the rectangular prism above-described. The buttressed ground pads 53 similarly presents further structure assuring rigidity at corners of the container 1. As with each of the buttressed ground pads 53, stringers 27 and frames 25, 23 and 21, in the preferred embodiment, the longerons are welded to the containment wall 3 to support the containment wall 3. In alternate embodiments, frames, stringers, and longerons 29 might also serve as parts of the containment wall 3 having plates welded between them to complete the structure of that containment wall 3, Plates or panels are fastened to the inside of the frame members 21, 23 and 25 to complete the front, back and side walls.

Having set forth the basic structural anatomy of the container 1, it is appropriate to describe the method of operation exploiting the inventive container 1. As has been explained above, the container 1 can be moved upon its rollers 39 for short distances, once delivered to a spill site. Likewise, with its hook bracket 13, the container can be winched onto a platform vehicle as is described in U.S. patent dated 17 Jan. 1984 and issued to Presseau et al.; the method being set forth at Col. 4, Line 41 to Col. 5, Line 13 (Applicant incorporates herein the whole of that patent by this reference). Otherwise, any of the conventional means of moving containers in shipping modes described above with reference to intermodal shipping may be used to transit greater distances, for example, to transport hazardous waste to an appropriate treatment plant, miles distant from the spill site.

The container 1 is used in conjunction with a vacuum truck such as that described in U.S. patent dated 29 Apr. 1980 and issued to Fisco; the method being set forth at Col. 5, Line 1 to Col. 6, Line 53 (Applicant incorporates herein the whole of that patent by this reference, though all vacuum generating means shall be referred to herein collectively as "vacuum truck" regardless of the exact means used to generate). This application lays no claim to any vacuum generating means, though the instant method relies upon vacuum being applied by any, vacuum generating means to either the front hose fitting 33 or the rear hose fitting 31. Assuming the vacuum truck applies an airtight hose connection at, for example, the rear hose fitting 31, the otherwise air tight interior wall of the containment wall 3 assures that a nearly equal vacuum is available at the front hose fitting 33.

Just as the vacuum truck the Fisco patent describes (the "Fisco vacuum truck"), a hose attached at the, in this example, front hose fitting 33 will draw air and accompanying dirt, liquid, and debris from land or other surfaces through a vacuum tool using similar tools as would the Fisco vacuum truck. Thus, the conventional user may use this container 1 in a manner as an extension to the hose of the Fisco vacuum truck. Advantageously, however, the container 1 is configured to retain all the spilled substance, dirt, and liquid within the container's 1 interior as gravity separates these from the air flow. The vast area of cross-section of the container 1 relative to the area of the cross-section of the vacuum hose causes the velocity of flowing air through the container 1 to slow significantly in a sort of reverse Bernoulli Effect. In fluid dynamics, Bernoulli's principle states that an increase in the speed of a fluid occurs simultaneously with a decrease in pressure or a decrease in the fluid's potential energy. Bernoulli deduced that pressure decreases when the flow speed increases and conversely that the flow speed decreases as the cross-section increases. Then, gravity takes over to release the entrained debris to settle in the interior of the container 1 as the air flow makes the transit the entire length of the container to assure that the air entering the vacuum truck through the rear hose fitting 31 is free of all but the smallest motes of dust. As the container 1 fills, the flow of air through container 1 remains free of debris. Naturally, the containment wall 3 and the framework cooperate to resist any differential in pressure between the ambient and the interior of the container 3 such operation imparts. The framework is sufficiently sized to withstand such stresses as imparted by any such differential. In, for example, a Supersucker® by Super Products can impart, through 8" hoses the following: through an 8" (20.3 cm) fitting a positive displacement vacuum system offers 5800 cfm/28" hg (9854 $m^3$/hr/0.95 bar).

To better understand the great utility of the inventive container 1, one can readily imagine the positive effect of the invention as a force multiplier in the task of collecting the approximately 12,000 barrels (500,000 US gal; 1,900 m3) of oil and water mix that was recovered in cleaning up the Mayflower oil spill; quite likely the residents of at least some of the twenty-two homes would not have required evacuation. Recalling that only eighteen vacuum trucks were available for cleanup and that much of each truck's duty cycle was consumed with transportation of oil to the frac farm. If, however, the vacuum trucks were freed from the transportation task, these eighteen trucks could have been in continuous service. Platform trucks such as those described in the Presseau patent could have been tasked with moving oil from the spill site to the frac farm, or, at the site, full containers could be stacked at the spill site or onto platform container rail cars or container bearing trucks to empty at a processing site.

The method is simple. First, at the spill site, provide a container 1 according to the described embodiments and a vacuum truck and a plurality of hoses. The operator will move the container 1 and vacuum truck into proximity with the spill. The operator will connect the hose between the intake at the vacuum truck and either of the front door hose fitting 31 and the rear door hose fitting 33. At the same time, the operator ill connect another hose to the remaining hose fitting 31, 33 and then to such a collecting nozzle as might be used absent the container 1. Once the hoses are connected, the vacuum truck begins operation collecting oil. Either by using the optional sight glass described above as in the inspection panel, or by using other means such as float gauges or sight glasses the sides might define, the operator can judge when the container 1 is operationally full. Once full, the container 1 can be disconnected from hoses connected to both hose fittings 31, 33 and a second container 1 can be swapped into the identical connective relation to the hoses.

The container 1 can, when full, in one embodiment, be removed on the platform vehicle known as a roll-off truck or a roll-off dumpster truck described in the Presseau patent. The roll-off truck is backed up to the full container 1 at its front wall 5. A cable (69 as denominated in the Presseau patent) is hooked to the hook bracket 13 and the platform the roll-off truck includes, tips back to engage the lower edge of the front wall 5. A winch on the vehicle then draws in all of the slack and then urging the container 1 to roll up the platform under the tension of the cable. As the cable is drawn onto the winch, the container 1 rolls up the platform. To minimize the necessary tension on the cable, the platform tilts back to a level position. When the container 1 reaches its secure position, it can be further secured to the platform for transportation to the remote processing center.

One can readily perceive that the ability to break out the container 1 as an interchangeable node in a modular collection system allows an efficiency in collection that exploits the rarer, more expensive element in the collection task fully while the inventive container 1 might be inexpensively stockpiled. Further, depending upon the distance to the ultimate destination for the spilled contaminants, one can readily imagine staging collection such that containers 1 are shuttled from the spill site in staged departures to entirely take up the transit time along with evacuation time as a complete cycle. Properly dividing that time interval, transit and evacuation time, allows ongoing collection during the whole of that interval. The volume of removed, collected material relative to each available vacuum truck is that way optimized. In first hours of collection, the collection is practically unceasing; with operators working in shifts, one can readily perceive the rapidity of collection possible and the advantageous speed in which containment might occur relative to the conventional means used in the Mayflower cleanup. The present invention therefore utilizes a very efficient construction for exploiting the modular nature of the vacuum truck/hose/container 1.

Returning, then, to the hardware necessary to effect the inventive function, as expressed above, the container 1, when in vacuuming mode, is airtight except relative to each of the front door hose fitting 33 and the rear hose fitting 31. In function, the container 1 serves to fulfill all the function of a length of vacuum hose from fitting to fitting but includes, additionally, the significantly larger area the constant cross-section containment wall 3 defines. That significantly larger cross-section enables the collection function as described above. But, to function as described, each of the other ports, the inspection panel 9, the rear door 15, and the stopcock 51 must all have a sealed position to assure that the container functions appropriately. The remainder of this specification will focus on the structure necessary to effect the object of the container 1.

Figure 12:
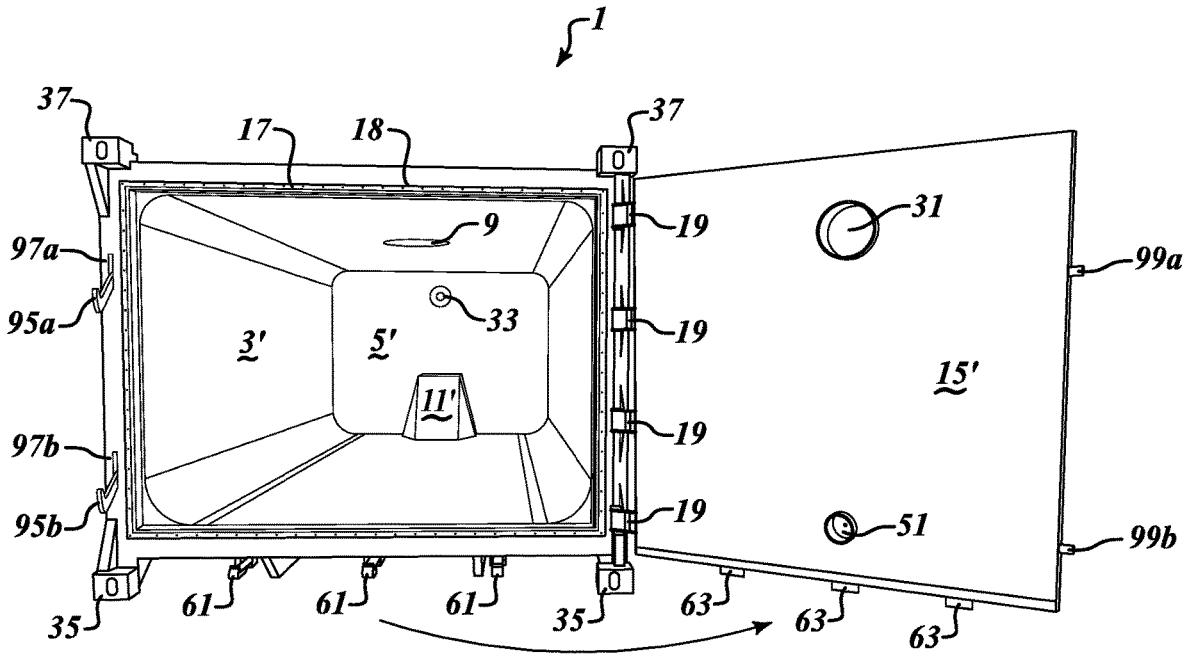
FIG. 12 is a rear elevation and depicts the door in an open position also portraying the interior of the sludge containment vessel.

As it is the single largest portal in the container 1, the rear door 7 can admit the largest volume of air should it be misconfigured. To that end, not only is the rear door 7 constructed to preserve its state of flatness as described above, but the latching mechanisms that facilitate a sealing engagement between the door 7 and the jamb the rear frame 21 comprises in the preferred embodiment. (Certainly, there exist other means to configure a sealing door, such as, for example, either of U.S. Pat. No. 5,639,129, dated 17 Jun. 1997 to Lindley or U.S. Pat. No. 6,929,146 dated 16 Aug. 2005 to Galbreath et al. both of which are incorporated in their entirety by these references.) In this embodiment of the inventive container 1 comprises a monolithic door 7 sized and shaped to mate with and sealingly close off the octagonal opening the containment wall 3 defines. In this embodiment, the rear frame 21 includes a C-shaped gasket channel 18 which holds, along its length, a gasket 17 (FIG. 12). The gasket channel 18 extends in a continuous octagonal run, substantially as shown in FIG. 12, to correspondingly mate with the continuous sealing bead 35 so that, when door 12 is closed and pulled against the rear end of container body 5, sealing bead 35 bears against and forms a fluid tight seal against gasket 44. Other sealing assemblies are contemplated besides that of bead, channel 18 and gasket 17. Such assemblies would include the bead being formed on door 7 and the gasket 17 being connected with the containment wall 3. Such assemblies would also include any alternative structure, either individually or in combination, for bead, channel 18 and gasket 17 that will form a fluid tight seal in association with the closing of door 7.

The door 7 is secured by two distinct latching mechanisms referred to herein in reference to where they rest relative to the door 7, i.e. bottom latching mechanism and side latching mechanism. As to establishing a vacuum seal, the side latching mechanism is described relative to FIGS. 10 and 11 below. To lock the door against the weight of the collected liquid, however, a distinct latching system assures leakless collection. Rather than to exert a clamping force to sealingly deform the gasket 17, the bottom latching mechanism holds the door against the weight of collected contaminate material to lock the door against accidental and explosive release. The hydrostatic pressure the contaminate exerts on the door is greatest at the base. Hydrostatic pressure is the pressure that is exerted by a fluid at equilibrium at a given point within the fluid, due to the force of gravity. Hydrostatic pressure increases in proportion to depth measured from the surface because of the increasing weight of fluid gravity exerts on the liquid. For that reason, the bottom latching mechanism 60 depicted in FIGS. 6, 7, 8, and 9 is configured to lock the container door against that hydrostatic pressure.

Figure 6:
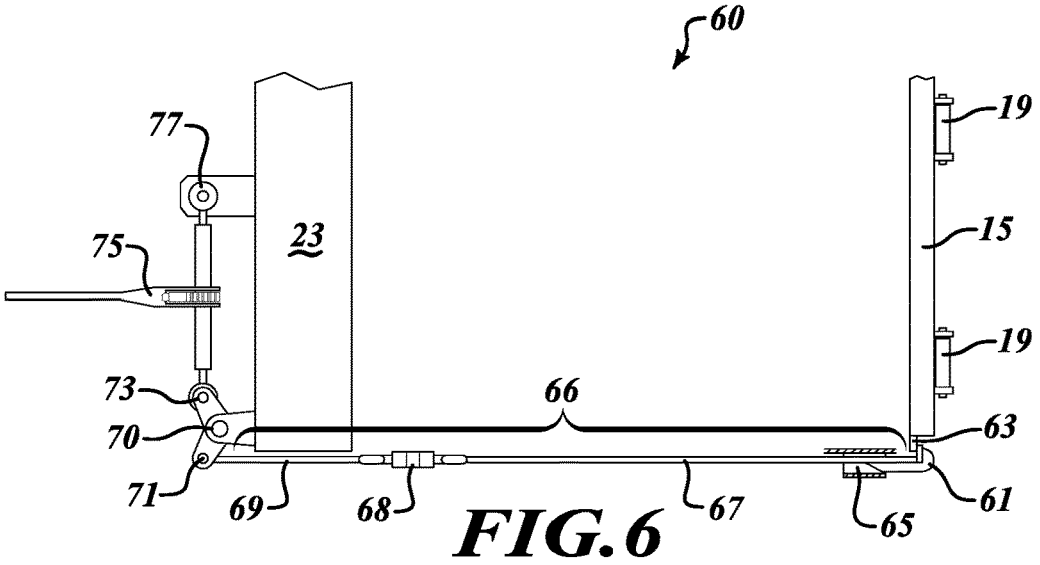
FIG. 6 is a left elevation view depicting the ganged bottom latching mechanism in a disengaged position including a ratchet tensioning turnbuckle.
Figure 7:
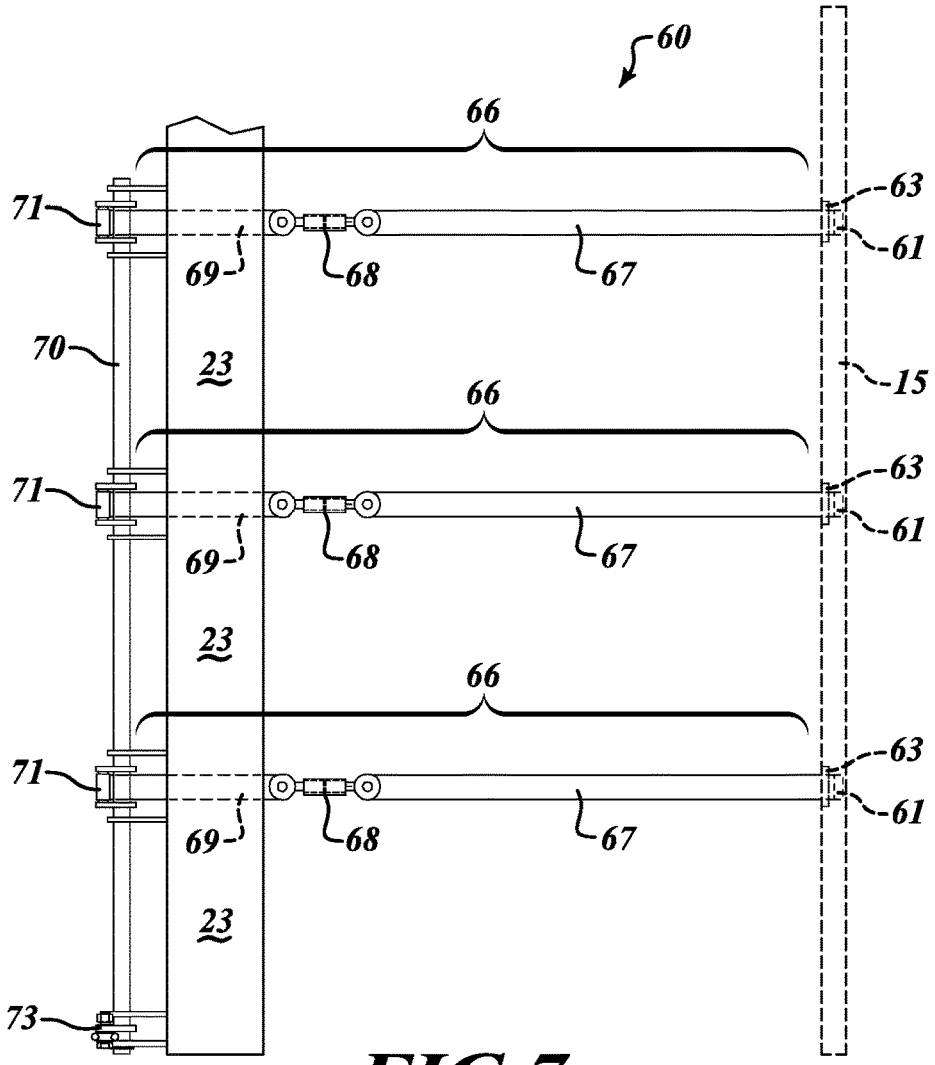
FIG. 7 is a bottom plan view depicting the ganged bottom latching mechanism in the disengaged position including rotary adjusters.
Figure 8:
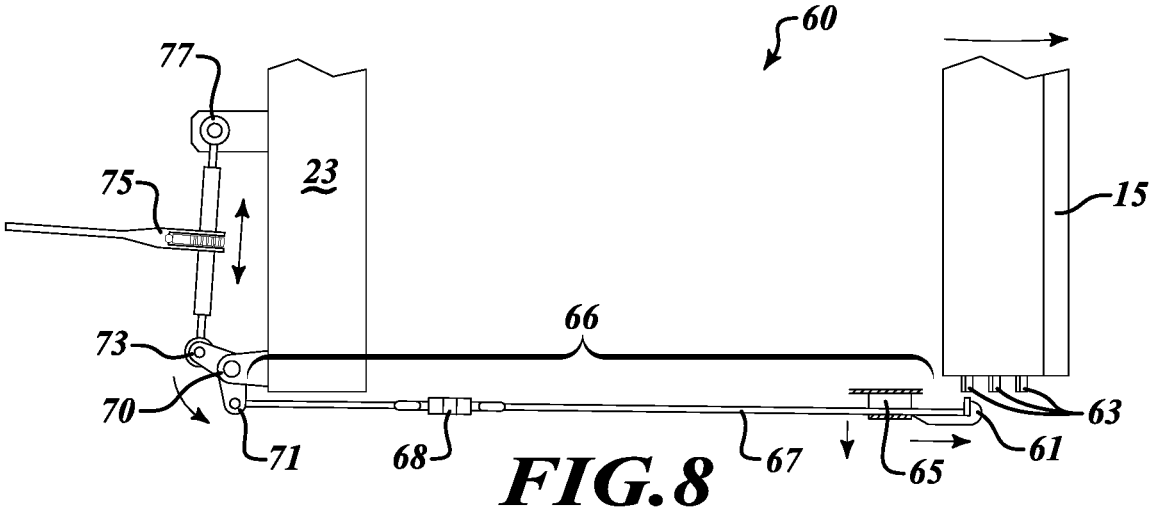
FIG. 8 is a left elevation view depicting the ganged bottom latching mechanism in an engaged position including the ratchet tensioning turnbuckle.
Figure 9:
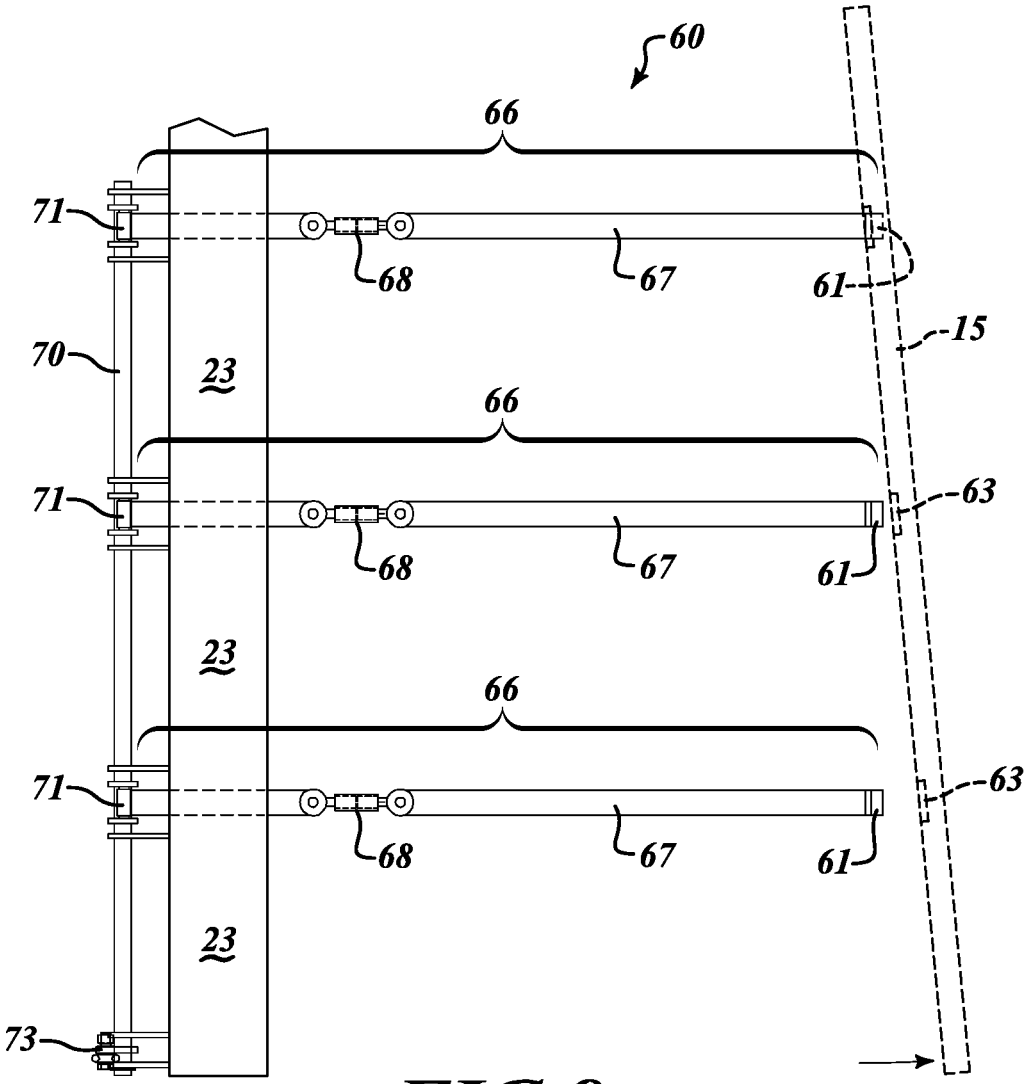
FIG. 9 is a bottom plan view depicting the ganged bottom latching mechanism in the engaged position including the rotary adjusters.

Referring, then, to FIGS. 6, 7, 8, and 9, a ganged bottom latch mechanism 60 is depicted. FIG. 6 is a left elevation view depicting the ganged bottom latching mechanism 60 in a disengaged position including a ratchet tensioning bottom turnbuckle; FIG. 7 is a bottom plan view depicting the ganged bottom latching mechanism 60 in the disengaged position including rotary adjusters; FIG. 8 is a left elevation view depicting the ganged bottom latching mechanism 60 in an engaged position including the ratchet tensioning bottom turnbuckle; and FIG. 9 is a bottom plan view depicting the ganged bottom latching mechanism 60 in the engaged position including the rotary adjusters. The actions of the ganged bottom latching mechanism 60 can best be described in terms of these two distinct positions: engaged and disengaged. In operation, the rear door 15 would be locked after the door 7 is swung into engagement and, first, locked by the side latching mechanism described in FIGS. 10 and 11. Once the side latching mechanism is so secured, the bottom latching mechanism 60 is then engaged.

The most elemental engagement the bottom latching mechanism 60 achieves is between the hook 61 and the boss 63. In the fully clamped position, the hook 61 is forcibly drawn forward engaging with the boss 63 which is, itself, connected to the underside of the rear door 15, positively compressing the gasket 17 into the channel 18 and holding the rear door 15 in locked engagement with the rear frame 21. The hook 61 resides in a hook channel 65 extending from the rear frame on an underside immediately adjacent to a corresponding boss 63 on the rear door 15 when the rear door 15 is in a closed position. The channel 65 encircles the hook 61 on its lateral sides and top and bottom. The hook 61 is pivotally attached to a being configured to underride the boss 63 when the bottom latching mechanism 60 is disengaged. Thus, locking occurs when bottom turnbuckle 66 draws the hook 61 to which it is pivotally attached into the channel 65 such that the hook 61 is drawn upwards against the boss 63 to engage it as the bottom turnbuckle 66 moves forward. When the bottom turnbuckle 66 moves backwards towards the rear door 15, the hook 61 emerges from the channel 65 extending the hook 61 out of the channel 65. As the hook 61 emerges, the hook 61 extends beyond the channel and the influence of gravity drops the hook 61 out of engagement with the boss 63 releasing the rear door 15. The pivot (not shown) connecting the hook 61 to the bottom turnbuckle 66 only allows rotation in a vertical plane containing the bottom turnbuckle 66 such that the hook 61 rotates from the engaged position shown in FIG. 6 to the disengaged position shown in FIG. 8 and back again.

The bottom turnbuckle 66 comprises three distinct pieces that function together to shorten or lengthen the bottom turnbuckle. An adjuster frame 68 defines two coaxial bores in opposed relation within the adjuster frame 68. The bores are threaded, one with a left-hand thread and the other with a right-hand thread. A left-handed tie rod 67 includes a pivot eye (not shown) to engage the pivot on the hook 61 and a left-handed threaded end to engage the adjuster frame 68 by meshing with the left-handed threaded bore. In a similar manner, a right handed tie rod comprises a pivot eye (not shown) and a right-handed end to engage the adjuster frame 68 by meshing with the right-handed threaded bore The turnbuckle length can be adjusted by rotating the adjuster frame 68, which causes both the right-handed and the left-handed threaded bores to simultaneously advance or withdraw along the correspondingly threaded ends of the tie rods 67,69. Because the action of a turnbuckle is well-known in the art, one having ordinary skill in the art would readily select the capacity, configuration, and length of the appropriate bottom turnbuckle 68.

The bottom latching mechanism 60 relies upon ganged hooks 61 and ganged bosses 63 to simultaneously engage and lock the rear door 15 against hydrostatic pressure the contained liquid within the container 1 exerts on the rear door 15. Simultaneous tensioning of the hooks 61 is achieved by rotation of a crankshaft 70 upon which two sets of crank throws reside: the turnbuckle crank throws 71 and the binder crank throw 73. Together, the crankshaft 70, the turnbuckle crank throw 71 and the binder crank throw 73 function very similarly to a series of bell cranks in that the bell crank is a type of crank that changes motion through an angle. The angle can be any angle from 0 to 360 degrees, but 90 degrees and 180 degrees are most common. A bottom ratchet binder 75 spans between a binder bracket 77 which extends from an intermediate frame 23 and the binder crank throw 73. (The working of the bottom ratchet binder 75 is exactly that of the side ratchet binder 81 described in detail below.) As the bottom ratchet binder 75 retracts, it draws the binder crank throw 73 upward. In response, the crankshaft 70 rotates in a clockwise fashion, drawing each of the turnbuckle cranks leftward as depicted in FIG. 6 and FIG. 7. Because these turnbuckle crank throws 71 are pivotally connected to the ganged turnbuckles 66 drawing the hooks 61 into further engagement with the bosses 63 extending from the rear door 15 drawing the door into tighter engagement with the door gasket 17.

So, the crankshaft 70 synchronously draws or presses the turnbuckles 66 either to the left or to the right as the bottom ratchet binder 75 shall extend or retract. As described throughout, the flatness of the rear door 15 is an important feature as that flatness draws the rear door 15 evenly into engagement with the gasket 17. But, as described above, the hydrostatic pressure collected liquid exerts against the rear door 15 is tremendous. The very purpose of ganging the turnbuckles 66, hooks 61 and bosses 63 was to assure that there was sufficient tension exerted on the rear door 15 across its width to countervail that hydrostatic pressure. To assure that each hook 61 moves in the same range and in synchronicity, the several adjuster frames 68 are employed to even the extent of hooks' 61 movement. Rotation of these adjuster frames 68 either extends or retracts the hooks 61 relative to the turnbuckle crank throw 71 to bring the turnbuckle to optimum length. This adjustability of these turnbuckles 66 is the reason that such a configuration is regarded as the presently preferred embodiment. Having said that, the alternate arrangement of the bottom latching mechanism might be as set out in the Lindley patent as incorporated above, especially as set out in FIGS. 2-7 and 12 and explained beginning at Col. 4, Line 24 and extending to Col. 6, Line 19, and Col. 7, Lines 1-28.

Figure 5:
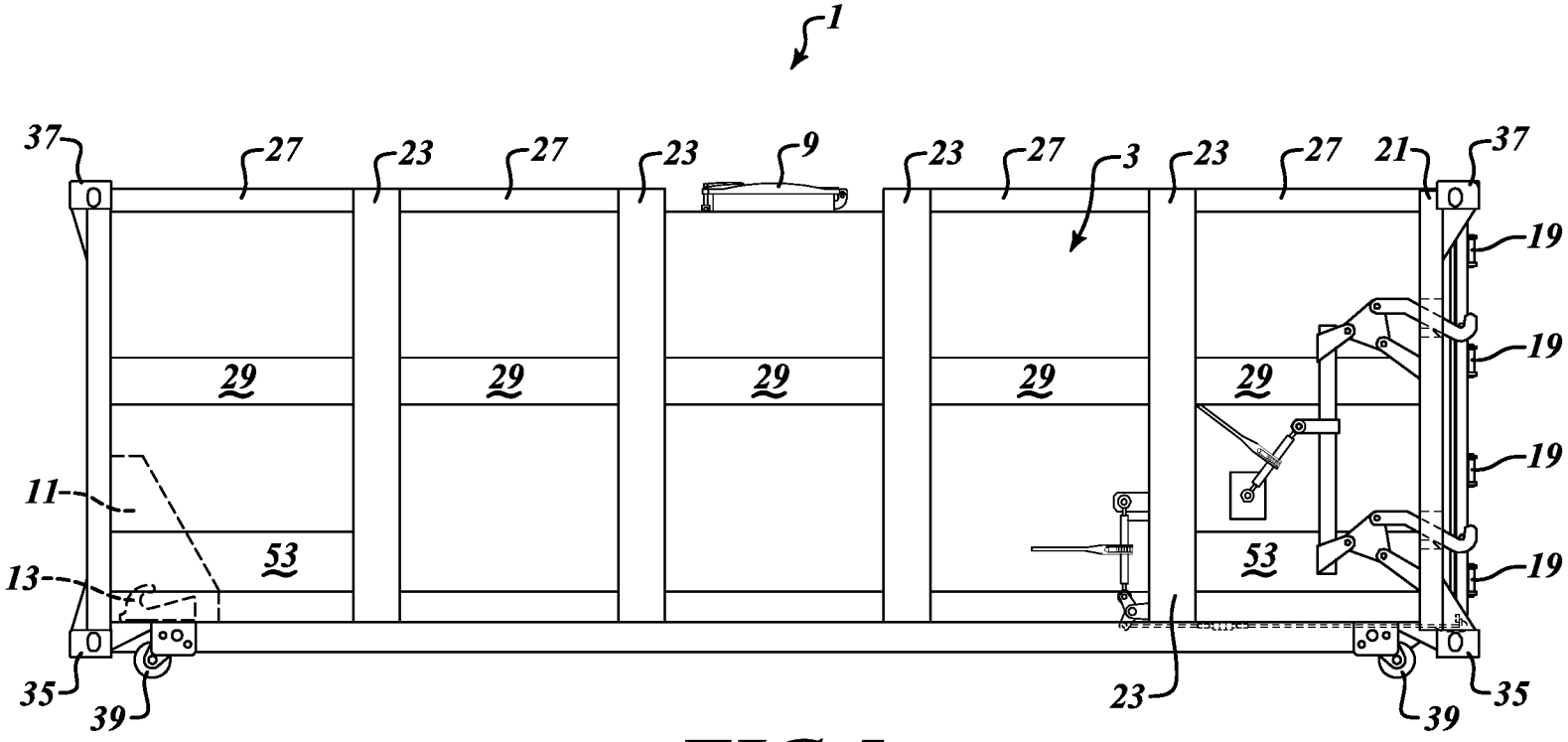
FIG. 5 is a right elevation of the inventive sludge containment vessel.
Figure 10:
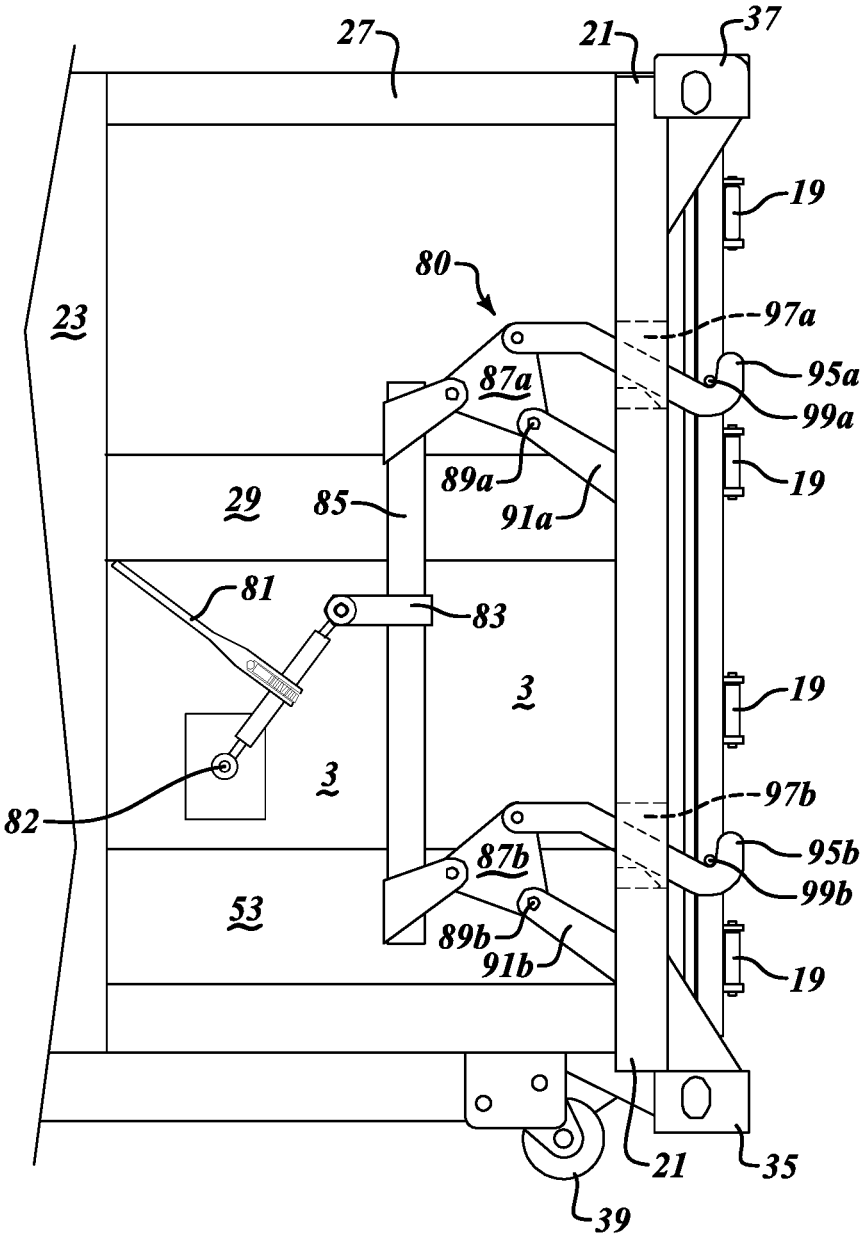
FIG. 10 depicts tensioning side latches in an engaged position and a ratcheting tensioner to adjust engagement of a closed door.
Figure 11:
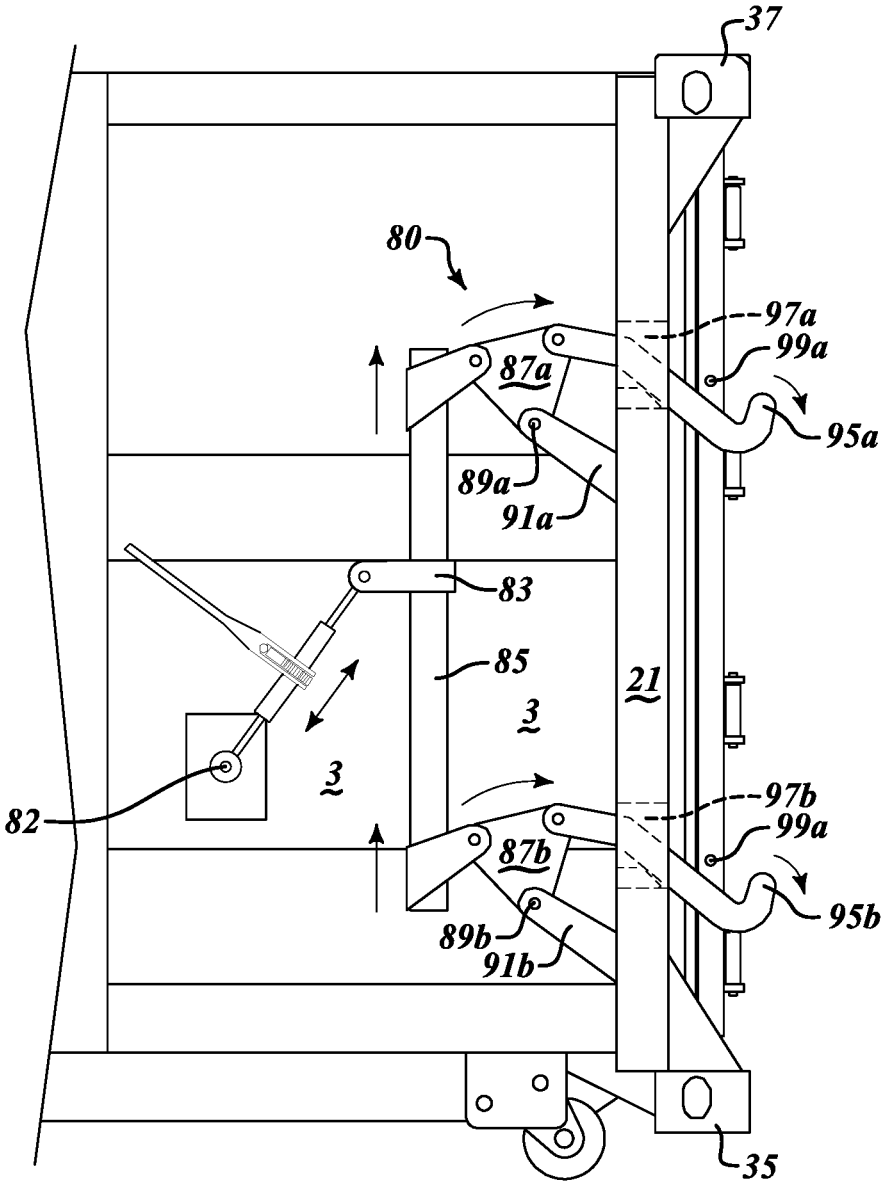
FIG. 11 depicts the tensioning side latches in a disengaged position and the ratcheting tensioner to adjust engagement of the door.

Referring now to FIGS. 5, 10 and 11, the operation of side latching mechanism 80 relies upon the action of a side ratchet binder 81. A ratchet is a mechanical device consisting of a gear and pawl. The ratchet will allow a frame of a turnbuckle to turn in a circular motion in one direction but not in the opposite direction. The side ratchet binder 81 includes a reversible ratchet which when the pawl is set in a first position, it will engage the ratchet and allow the tool to turn only clockwise. When the pawl is set in a second position, it will engage the ratchet and allow the tool only to turn in an anti-clockwise direction. The side ratchet binder 81 uses a ratchet mechanism to turn an adjuster barrel according to the position of the pawl. It has a ratchet handle and two eyebolts, in opposed positions, one on each end. The side ratchet binder 81 is selected over a lever binder in this preferred embodiment, in that the side ratchet binder 81 doesn't store much energy in the handle, there is less risk of the bar recoiling or snapping, making the ratchet binder a safer option over the lever binder.

The side ratchet binder 81 is rotatably attached to the containment wall 3 at a binder pivot 82. At its opposite end, the side ratchet binder 81 is rotatably attached to a pivot link 83 affixed to a connecting bar 85. The connecting bar 85 is pivotally connected on opposing ends to an upper bell crank 87*a* and a lower bell crank 87*b*. The upper bell crank 87*a* rotates about a fixed pivot an upper bell crank bracket 89*a* presents. Likewise, the lower bell crank 87*b* rotates about a fixed pivot a lower bell crank bracket 89*b* presents. Upon extension of the side ratchet binder 81, the pivot link 83 moves upward bringing with it the connecting bar 85. The upward movement of the connecting bar rotates the bell cranks 87*a*, 87*b* in a clockwise direction about the fixed pivots, as shown in FIG. 11. In the opposite manner, retraction of the side ratchet binder 81 rotates the bell cranks 87*a*, 87*b* in a counterclockwise direction about the respective fixed pivots. An upper locking bar 95*a* passes through an upper locking bar slot 97*a* the rear frame 21 defines. Again, in a similar manner, a lower locking bar 95*b* passes through a lower locking bar slot 97*b* the rear frame 21 defines. Each locking bar 95*a*, 95*b* are pivotally connected to their respective bell cranks 87*a*, 87*b*. The upper locking bar 95*a* engages an upper locking pin 99*a* affixed to the door. The lower locking bar 95*b* engages a lower locking pin 99*b* in a similar and simultaneous movement which, together, draw the door into sealing contact with the gasket 17, causing it to deform sufficiently to fill the gasket channel 18, thereby forming an airtight seal. Advantageously, once airtight should the internal pressure fall (as in use) relative to the ambient, the higher ambient air pressure will further drive the door 15 into sealing engagement with the gasket 17.

Referring to FIG. 12, one can readily perceive that the container 1 defines an interior cavity that is smooth. That cavity is defined by the interior of the containment wall 3', the interior of the front wall 5', the interior of the door 15'. The smoothness of the interior is selected in the preferred embodiment to facilitate complete evacuation of the interior. Considering the broad spectrum of contaminants that might be collected by use of the invention in conjunction with vacuum trucks, cross-reaction is a great possibility. For that reason, after draining the container 1 of liquid, such as oil, the operator may well determine that pressure washing is necessary before making the container 1 available for an alternate contaminate. The lack of ridges and the optional use specific and impervious coatings such as epoxy or PTFEe to clad the interior surfaces assuring complete evacuation of contaminants, assures that simple and commonly available cleaning procedures such as pressure washing will prevent cross-reaction. Also visible in this diagram are the gasket 17 and channel 18, the bosses 63 and hooks 61, along with the locking arms 95*a*, 95*b*, the locking pins 99*a*, 99*b*.

The embodiments of the invention in which an exclusive property or privilege is claimed are defined as follows:

1. A container for use with a vacuum truck including a vacuum pump and at least two vacuum hoses, comprising:

a container body including;

at least a containment wall to form, generally, a generally rectangular tube suspended within a framework comprising at least one intermediate frame, a front frame and a rear frame, the frames being held in spatial relation by two longerons, each longeron extending along a lateral side of the exterior of the generally rectangular tube from opposing midpoints on two lateral sides of the front frame to corresponding midpoints on two lateral sides of the rear frame joining each of the at least one intermediate frame elements at corresponding midpoints, the rear frame element of the framework defining a door opening, the door opening having a hinge side, a latch side and a bottom side;

a container closure including a door panel sized to fit the door opening, the door panel being hingedly attached relative to the rear frame elements at the hinge side and being movable to occupy the door opening, the door panel further defining a drain port under a horizontal beam the door panel comprises, the drain port including a stopcock, the stopcock having an open and a closed state, the stopcock being selectably movable from the open to the closed state or from the closed to the open state;

a compressible sealing gasket carried by at least one of the door panel and the frame elements, the gasket being compressed between the door panel and the frame elements, under an operative sealing pressure when the container closure is sealed drawing the door panel into a closing position into engagement with the door opening, wherein compression of the gasket resists hinging movement of the door panel into the closing position;

at least one closing mechanism for drawing the door panel and the frame elements in engaged conjunction resulting in the compression of the gasket, the closing mechanism being disposed along at least part of an edge of the door opening; and, a door-latching mechanism including a plurality of hooks and a bottom ratchet binder, the door-latching mechanism operable to latch by operating the bottom ratchet binder to draw the plurality of hooks to engage corresponding bosses the door panel includes;

the container body defining at least two ports, each of the two ports being situated above the midpoints of the frames and comprising fittings to engage one of the two vacuum hoses such that any volume the vacuum truck draws through one of the hoses, the container body draws a corresponding volume through the other of the two ports.

2. The container of claim 1, wherein each of the front frame and the rear frame further include corner castings formed to comply with ISO standards.

3. The container of claim 1, wherein the hooks the door-latching mechanism comprises are disposed along the bottom edge of the door opening.

4. The container of claim 1, wherein a plurality of hinges hingedly couple the door panel to the rear frame, the plurality of hinges aligned along a hinge axis, the hinge axis being oriented vertically at hinge side of the door opening.

5. The container of claim 1, wherein closing mechanism includes a side ratchet binder and further comprising at least one locking bar to engage at least one locking pin the door comprises, the side ratchet binder being configured to draw the at least one locking bar into locking engagement with the at least one locking pin such that tightening the side ratchet binder will draw the door panel into tighter engagement with the door gasket.

6. The container of claim 1, wherein each of the front and rear frames further comprise rollers and wherein the front frame further comprises a hook, the hook and several rollers being positioned to allow the container to be drawn onto, transported, and released from a roll-off truck.

7. A container for use with a vacuum truck including a vacuum pump and at least two vacuum hoses, comprising:

a container body having at least side walls, a top wall, and a bottom wall, and, further, having frame elements at least partly forming a door opening with a hinge side, a latch side and a bottom side, the container body being of sufficient strength to withstand a one bar pressure differential between interior and ambient;

a container closure including a door panel sized to fit a door opening the rear frame defines, the door panel having each of a hinge edge, a latch edge and a bottom edge corresponding to similarly named sides of the door opening, the door panel being hingedly attached to the rear frame at the hinge edge, and to the door panel at the hinge edge, the door panel being movable to occupy the door opening in a closing position, the door panel further defining a drain port under a horizontal beam the door panel comprises, the drain port including a stopcock, the stopcock having an open and a closed state, the stopcock being selectably movable from the open to the closed state or from the closed to the open state;

a compressible sealing gasket carried by at least one of the door panel and the frame elements, the gasket being compressed between the door panel and the frame elements under an operative sealing pressure when the container closure is sealed with the door panel occupying the closing position in the door opening;

the container body defining at least two ports, each of the two ports being situated above midpoints the frames include and comprising fittings each to engage one of the two vacuum hoses such that when the door is in sealing engagement with the container body, any volume the vacuum truck draws through one of the hoses, the container body draws a corresponding volume through the other of the two ports;

a closing mechanism for drawing together the door panel and the frame elements in conjunction with compressing the gasket, the closing mechanism being disposed along at least part of the latch side of the door opening, including at least one locking bar extending from the latch side to engage at least one corresponding locking pin situated on the latch edge, the container body being capable of water- and air-tight integrity when the closing mechanism is fully engaged, the door panel occupying the closing position; and a door-latching mechanism to fix the door against hydrostatic pressure liquid within the container body exerts on the door panel, the door-latching mechanism including a plurality of hooks and a bottom ratchet binder coupled to the plurality of hooks to draw the hooks to engage a plurality of corresponding bosses the door panel includes.

8. The container of claim 7, wherein the closing mechanism includes a side ratchet binder and at least one locking bar at the latching side to engage at least one corresponding locking pin the latching edge comprises, the side ratchet binder being configured to draw the at least one locking bar into locking engagement with the at least one locking pin.

9. The container of claim 8, further wherein each of the plurality of hooks the door-latching mechanism comprises includes length-adjusting turnbuckles, to synchronize the engagement of the plurality of hooks when the bottom ratchet binder is operated to cause the plurality of hooks to engage the plurality of corresponding bosses the door panel includes.

10. The container of claim 7, wherein the container body includes front and rear frames which, themselves, further each comprise at least two rollers and wherein the front frame further comprises a hook, the hook and several rollers being positioned to allow the container to be drawn onto, transported, and released from a roll-off truck.

11. The container of claim 10, wherein the front and rear frames include corner castings in accord with ISO standards for intermodal shipping containers.

12. The container of claim 7, wherein the container body defines at least one inspection panel.

13. The container of claim 7, wherein each of the at least one locking bar extending from the latch side to engage at least one corresponding locking pin situated on the latch edge includes a locking bar slot and a bell-crank such that a side ratchet binder will draw the at least one locking bar extending from the latch side to tighter engagement with the at least one corresponding locking pin situated on the latch edge.

14. A waste container for use with a vacuum truck and at least two vacuum hoses, comprising:

a container body defining at least one door opening and two hose ports;

a door, the door being sized and configured to close off the at least one door opening, the door further defining a drain port under a horizontal beam the door panel comprises, the drain port including a stopcock, the stopcock having an open and a closed state, the stopcock being selectably movable from the open to the closed state or from the closed to the open state;

a hinge assembly connected between the container body and the door to permit the door to swing between a closed position covering the opening and an open position uncovering the opening, the hinge assembly including at least one hinge;

a seal connected with one of the container body and the door, the seal being juxtaposed relative to the container body and the door to provide an air- and fluid-tight seal between the container body and the door when the door is in a closed position;

a closing assembly mechanically connected between the container body and the door to draw the door into the closed position and, further, drawing the door into sealing engagement with the container body;

a latching assembly mechanically connected between the container body and the door to hold the door in the closed position and in that closed position, including a plurality of hooks and a bottom ratchet binder, the door-latching mechanism operable to latch by drawing the plurality of hooks to engage a plurality of corresponding bosses the door panel includes; and, each of the hose port having fittings being configured to sealingly engage one of the at least two vacuum hoses the ports being arranged such when the door is in the closed position to provide an air- and fluid-tight seal between the container body and the door, any volume the vacuum truck draws through one of the hoses, the container body draws a corresponding volume through the other of the two ports.

15. The waste container of claim 14 wherein the control mechanism includes a side ratchet binder and at least one locking bar at the latching side to engage at least one corresponding locking pin the latching edge comprises, the side ratchet binder being configured to draw the at least one locking bar into locking engagement with the at least one locking pin.

16. The waste container of claim 15 wherein each of the at least one locking bar extending from the latch side to engage at least one corresponding locking pin situated on the latch edge includes a locking bar slot and a bell-crank such that a side ratchet binder will draw the at least one locking bar extending from the latch side to tighter engagement with the at least one corresponding locking pin situated on the latch edge.

17. The waste container of claim 14 wherein each of the plurality of hooks the door-latching mechanism comprises includes length-adjusting turnbuckles, to synchronize the engagement of the plurality of hooks when the bottom ratchet binder is operated to cause the plurality of hooks to engage the plurality of corresponding bosses the door panel includes.

18. The waste container of claim 14 wherein the container body includes front and rear frames which, themselves, further each comprise at least two rollers and wherein the front frame further comprises a hook, the hook and several rollers being positioned to allow the container to be drawn onto, transported, and released from a roll-off truck.

19. The container of claim 18, wherein the front and rear frames include corner castings in accord with ISO standards for intermodal shipping containers.

* * * * *